US011174132B2

(12) United States Patent
Lusty et al.

(10) Patent No.: US 11,174,132 B2
(45) Date of Patent: Nov. 16, 2021

(54) ROCK TONGS

(71) Applicant: BAC INDUSTRIES, INC., Miltona, MN (US)

(72) Inventors: Robert H. Lusty, Alexandria, MN (US); James D. Oberg, Eagle Bend, MN (US)

(73) Assignee: BAC Industries, Inc., Miltona, MN (US)

( * ) Notice: Subject to any disclaimer, the term of this patent is extended or adjusted under 35 U.S.C. 154(b) by 94 days.

(21) Appl. No.: 16/793,171

(22) Filed: Feb. 18, 2020

(65) Prior Publication Data

US 2021/0253402 A1 Aug. 19, 2021

(51) Int. Cl.
*B66C 1/42* (2006.01)
*B66C 1/44* (2006.01)

(52) U.S. Cl.
CPC ..... *B66C 1/422* (2013.01); *B66C 1/442* (2013.01)

(58) Field of Classification Search
CPC ..... B66C 1/422; B66C 1/442
See application file for complete search history.

(56) References Cited

U.S. PATENT DOCUMENTS 1,356,515 A 10/1920 Burgson
2,009,453 A 7/1935 Pratt
2,279,570 A 6/1941 Kamppi
2,561,207 A 7/1951 Kellner
3,317,235 A 5/1967 Botten
3,759,564 A * 9/1973 Seaberg ..... B66C 3/16 294/198
5,666,758 A * 9/1997 Vaillier ..... A01K 97/24 294/110.1
6,012,752 A * 1/2000 Douglas ..... B66C 1/422 294/110.1
6,331,025 B1 * 12/2001 Douglas ..... B66C 1/442 294/110.1
6,568,731 B2 * 5/2003 Alexander, III ..... B66C 1/58 294/110.1
7,673,918 B2 3/2010 Cveykus
8,366,162 B2 * 2/2013 Imlach ..... B66C 1/30 294/118
9,242,840 B2 1/2016 Wenner et al.

* cited by examiner

*Primary Examiner* — Stephen A Vu
(74) *Attorney, Agent, or Firm* — Thomas J. Nikolai; DeWitt LLP

(57) ABSTRACT

A tong assembly for use with a work vehicle for grasping irregular shaped objects such as large rocks and smaller sized boulders. The tong assembly includes specially designed load engagement pads having a rectangular configuration of steel bars and attachable to the tong arms proximate their lower ends. A pair of the bars that extend parallel to one another, but normal to the tong arms have a serrated arcuate load engaging surface for enhancing the ability of the tong assembly to grasp and retain irregular shaped objects.

6 Claims, 2 Drawing Sheets

ROCK TONGS

STATEMENT REGARDING FEDERALLY SPONSORED RESEARCH OR DEVELOPMENT

Not applicable

CROSS-REFERENCED TO RELATED APPLICATIONS

Not applicable

BACKGROUND OF THE INVENTION

I. Field of the Invention

The present invention relates generally to a load lifting apparatus and, more particularly, to tongs for lifting irregularly shaped objects such as large rocks and boulders.

II. Discussion of the Prior Art

In the construction industry and in agriculture, it is often necessary to clear a field of large rocks and boulders. U.S. Pat. Nos. 2,561,207, 3,317,235, 9,242,840 and 7,673,918 are examples of grapples adapted for use with work vehicles such as tractors and skid steer loaders having hydraulically actuated lifting arms to which the grapple may be coupled for grasping and transporting a variety of loads.

The present invention is felt to be an improvement over the prior art, especially in the design of a rock tong arrangement with improved load engaging jaws that are able to engage irregularly shaped loads such as large rocks and small boulders and lift them without any unintended release.

SUMMARY OF THE INVENTION

The invention comprises lifting tongs especially designed to be used with a tractor or skid steer loader for grasping, lifting and transporting a variety of irregularly shaped objects such as large rocks and boulders. It comprises a conventional tong mechanism with specially designed load engagement pads shaped to engage such load items in a way that greatly inhibits loss of purchase of the load item once it has been lifted and is being transported. In accordance with the invention, the opposed pair of load engagement pads are of a rectangular configuration having a pair of parallel and spaced-apart bars affixed to and extending transversely with respect to the tong arms and where the pair of parallel and spaced-apart bars exhibit an arcuate and serrated edge as their load engaging surfaces.

BRIEF DESCRIPTION OF THE DRAWINGS

The foregoing features, objects and advantages of the invention will become apparent to those skilled in the art from the following detailed description of the preferred embodiment, especially when considered in conjunction with the accompanying drawings in which like numerals in the several views refer to corresponding parts.

DESCRIPTION OF THE PREFERRED EMBODIMENT

Figure 1:
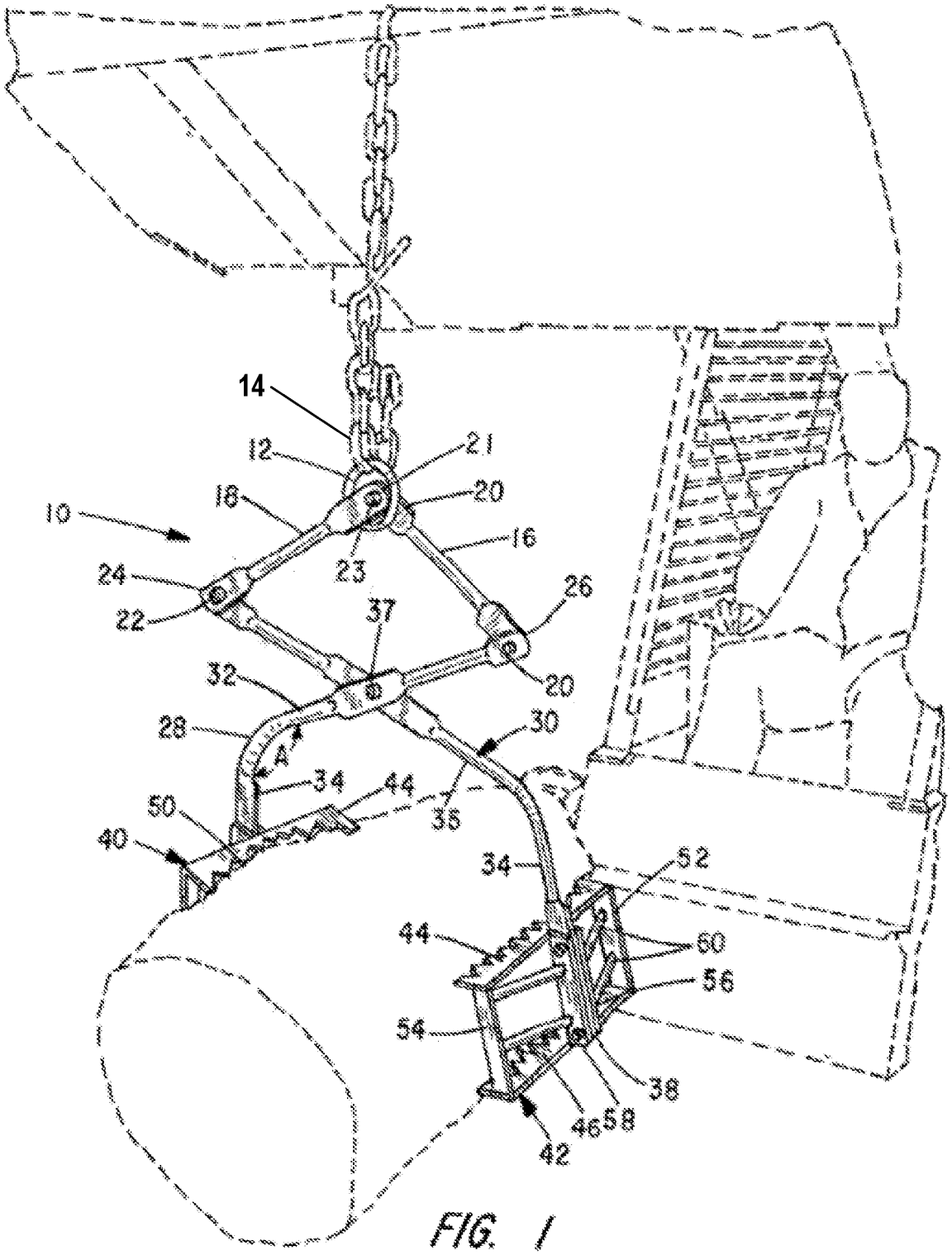
FIG. 1 is a perspective view of a preferred embodiment of the invention.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Referring first to FIG. 1, the rock tongs of the present invention is shown as being suspended by a chain from an elevated bucket of a skid steer loader type work vehicle. The vehicle itself forms no part of the invention and is therefore shown in dashed-line representation. The tong device is indicated generally by numeral 10 and comprises a ring 12 which is attached to a radially projecting first link member 14. The mode of attachment is preferably by welding, but the ring may be made to pass through an aperture formed through the link member 14.

Second and third linkages 16 and 18 have first end portions 20, 22 pivotally joined by a shoulder bolt or rivet 23 to the first link member 14 such that the links can pivot with respect to one another. The second end portions 24, 26 of the linages 16 and 18 are individually pivotally joined to a pair of tong arms indicated generally by numerals 28 and 30. The tong arms each comprise first and second rectilinear segments 32, 34 that are integrally joined at a predetermined obtuse angle, A. The first, upper, segments 32 of the tong arms are pivotally coupled to one another by a bolt or pin 37 at a location offset from the first ends thereof. In FIG. 1, the tong arms 28, 30 as well as the linkages 16, 18 are shown as being formed from round stock, but those skilled in the art will recognize that flat stock may be used as well. As seen in FIG. 1, the round stock is flattened, such as by a stamping operation, at the swivel point locations.

Figure 2:
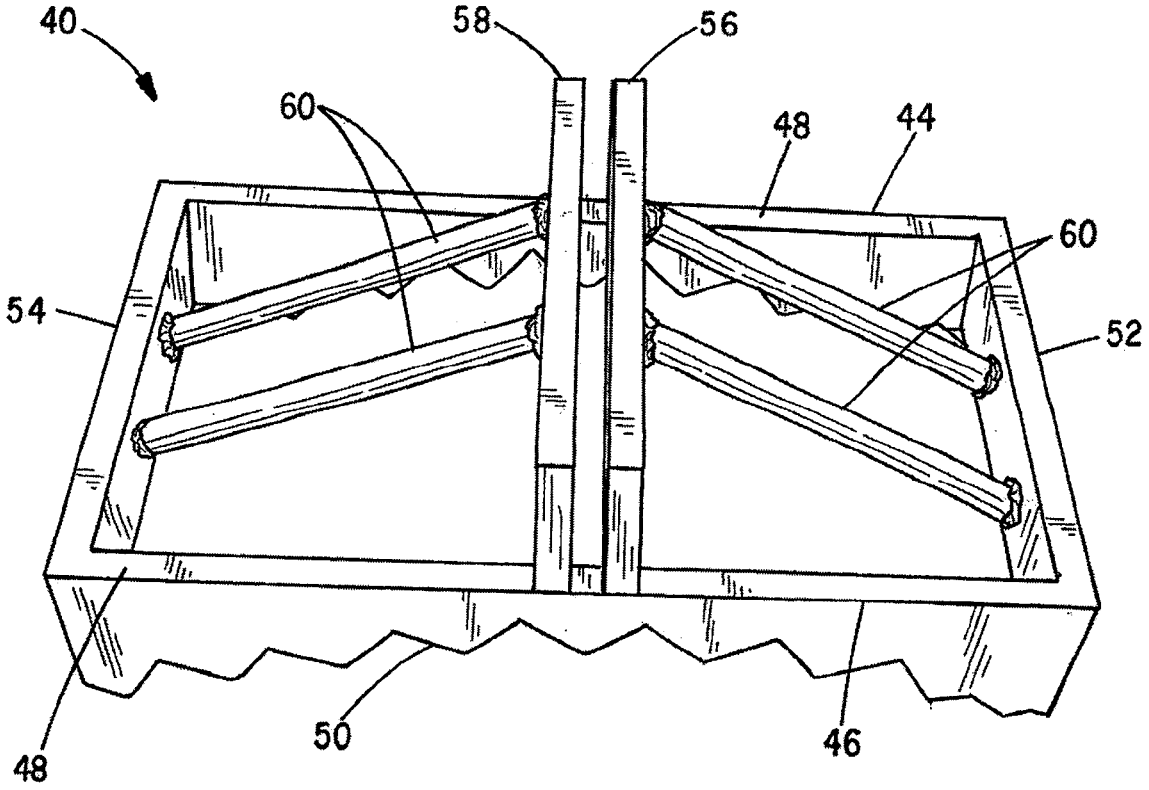
FIG. 2 is a detailed perspective view of the load engaging pad structure.

The lower end portion 38 of the second arm segments 34 are joined to load engagement pads 40, 42, preferably by bolts which allow for removal and replacement. More particularly, the load engaging pads have a generally rectangular configuration, as shown in FIG. 2. They include a pair of parallel, spaced-apart steel plates 44, 46, each with a rectilinear outer edge 48 and an arcuate inner edge 50, the arcuate inner edge being serrated. Opposed end portions of the plates 44, 46 are joined by end plates 52, 54 that are welded to the steel plates 44, 46.

In order to afford a connection of the load engagement pads 40, 42 to the arm segment 34 of the tong arms, the load engagement pads include a pair of closely spaced steel bars or straps 56, 58 where the spacing between them is sufficient to create a friction fit with the flat lower end portions of the tong arm segment 34. The steel bars or straps 56, 58 are welded to the rectilinear outer edges 48 proximate the midlength dimension thereof. Support struts, as at 60, are welded between the end plates 52, 54 and the straps 56, 58 to thereby reinforce a bolted connection of the load engagement pads 40, 42 with the tong arms 28, 30.

Without limitation, the tong structure may be designed so that the load engagement pads may be spaced apart about 24 inches when fully opened. At this extent of opening, the engagement pads are made to tilt at an angle of about 10 degrees with respect to the vertical such that the upper members 46 thereof are further spaced apart than are the lower members 48. This allows the load engagement pads to scoop beneath the load by a certain extent which also aids in the ability of the tongs to grasp irregular shaped loads. It has been determined through testing that by providing the arcuate serrated edges on the plates 44, 46, there is less slipping free of irregular shaped loads such as large rocks and boulders, as the tongs are used to lift and carry such loads.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A lifting tongs comprising:

a) a ring affixed at a perimeter thereof to a radially projecting first link member;

b) second and third link members each with first and second ends, the first ends of the first and second link members being pivotally coupled to the first link;

c) first and second tong arms each having first and second ends with said first ends of the tong arms pivotally coupled individually to the second ends of the second and third link members, the first and second tong arms each comprising first and second rectilinear segments integrally joined at a predetermined obtuse angle with the first rectilinear segment of the first tong arm pivotally joined to the first rectilinear segment of the second tong arm at a location offset from the first ends of the first and second tong arms;

d) first and second load engagement pads affixed individually to the second rectilinear segments of the first and second tong arms, said load engagement pads each comprising a rectangular configuration having a pair of parallel and spaced-apart bars affixed to and extending transversely to the second rectangular segment of the tong arms and a pair of parallel and spaced-apart bars extending between and joined to opposed ends of the transversely extending parallel and spaced-apart bars; and wherein the predetermined obtuse angle is such that the first and second load engagement pads are tilted approximately 10 degrees from the vertical whereby upper ones of the transversely extending parallel bars of the first and second load engagement pads are spaced further apart than lower ones of the transversely extending parallel bars of the first and second load engagement pads.

2. The lifting tongs of claim 1 wherein the pair of parallel and spaced-apart bars affixed to and extending transversely to the second rectangular segment of the tong arms each have an arcuate serrated edge load engaging surfaces.

3. The lifting tongs of claim 2 wherein said ring is adapted to be coupled to a hydraulically operated arm of a work vehicle.

4. A lifting tongs comprising:

a) a ring affixed at a perimeter thereof to a radially projecting first link member;

b) second and third link members each with first and second ends, the first ends of the first and second link members being pivotally coupled to the first link;

c) first and second tong arms each having first and second ends with said first ends of the tong arms pivotally coupled individually to the second ends of the second and third link members, the first and second tong arms each comprising first and second rectilinear segments integrally joined at a predetermined obtuse angle with the first rectilinear segment of the first tong arm pivotally joined to the first rectilinear segment of the second tong arm at a location offset from the first ends of the first and second tong arms;

d) first and second load engagement pads affixed individually to the second rectilinear segments of the first and second tong arms, said load engagement pads each comprising a rectangular configuration having a pair of parallel and spaced-apart bars affixed to and extending transversely to the second rectangular segment of the tong arms and a pair of parallel and spaced-apart bars extending between and joined to opposed ends of the transversely extending parallel and spaced-apart bars, wherein the pair of parallel and spaced-apart bars affixed to and extending transversely to the second rectangular segment of the tong arms each have an arcuate serrated edge load engaging surfaces; and e) a pair of steel straps affixed to an outer edge surface of the parallel and spaced-apart bars proximate a mid-length thereof and that extend parallel to the second segment of the tong arms, the straps being spaced from one another to create a gap into which the second segment of the tong arm tightly fits.

5. The lifting tongs of claim 4 and further including a plurality of struts, each affixed at a first end to one of said pair of straps and at an opposite end to said one of said parallel and spaced-apart bars that extend between and are joined to said opposed ends of the transversely extending parallel and spaced-apart bars.

6. The lifting tongs of claim 4 wherein the predetermined obtuse angle is such that the first and second load engagement pads are tilted approximately 10 degrees from the vertical whereby upper ones of the transversely extending parallel bars of the first and second load engagement pads are spaced further apart than lower ones of the transversely extending parallel bars of the first and second load engagement pads.

* * * * *